US005417343A

United States Patent [19]

Umiker

[11] Patent Number: 5,417,343

[45] Date of Patent: May 23, 1995

[54] STACKABLE BOTTLE CRATE MADE FROM PLASTIC MATERIAL

[75] Inventor: Hans Umiker, Egg, Switzerland

[73] Assignee: Schoeller-Plast SA, Romont, Switzerland

[21] Appl. No.: 836,010

[22] PCT Filed: Mar. 1, 1991

[86] PCT No.: PCT/EP91/00380

§ 371 Date: Sep. 17, 1992

§ 102(e) Date: Sep. 17, 1992

[87] PCT Pub. No.: WO92/15488

PCT Pub. Date: Sep. 17, 1992

[51] Int. Cl.[6] ..... B65D 1/24

[52] U.S. Cl. ..... 220/509; 220/669; 206/427

[58] Field of Search ..... 220/507, 509, 657, 658, 220/669; 206/203, 427

[56] References Cited

U.S. PATENT DOCUMENTS

| | | | |
|---|---|---|---|
| 4,067,474 | 1/1978 | Prodel | 206/427 X |
| 4,210,265 | 7/1980 | Umiker . | |
| 4,548,320 | 10/1985 | Box | 206/427 X |

FOREIGN PATENT DOCUMENTS

| | | |
|---|---|---|
| 414480 | 2/1991 | European Pat. Off. . |
| 3135633 | 6/1983 | Germany . |
| 3619833 | 12/1987 | Germany . |
| 3841806 | 6/1990 | Germany . |
| 1535229 | 12/1978 | United Kingdom . |

*Primary Examiner*—Steven M. Pollard
*Attorney, Agent, or Firm*—Sheridan Ross & McIntosh

[57] ABSTRACT

In a stackable bottle crate from plastic material, the side walls are reinforced by vertical hollow profiled columns which are extended up to the upper marginal edge of the crate side walls and together with the upper marginal edge from a circumferential piling edge for load reduction.

30 Claims, 5 Drawing Sheets

STACKABLE BOTTLE CRATE MADE FROM PLASTIC MATERIAL

Figure 1:
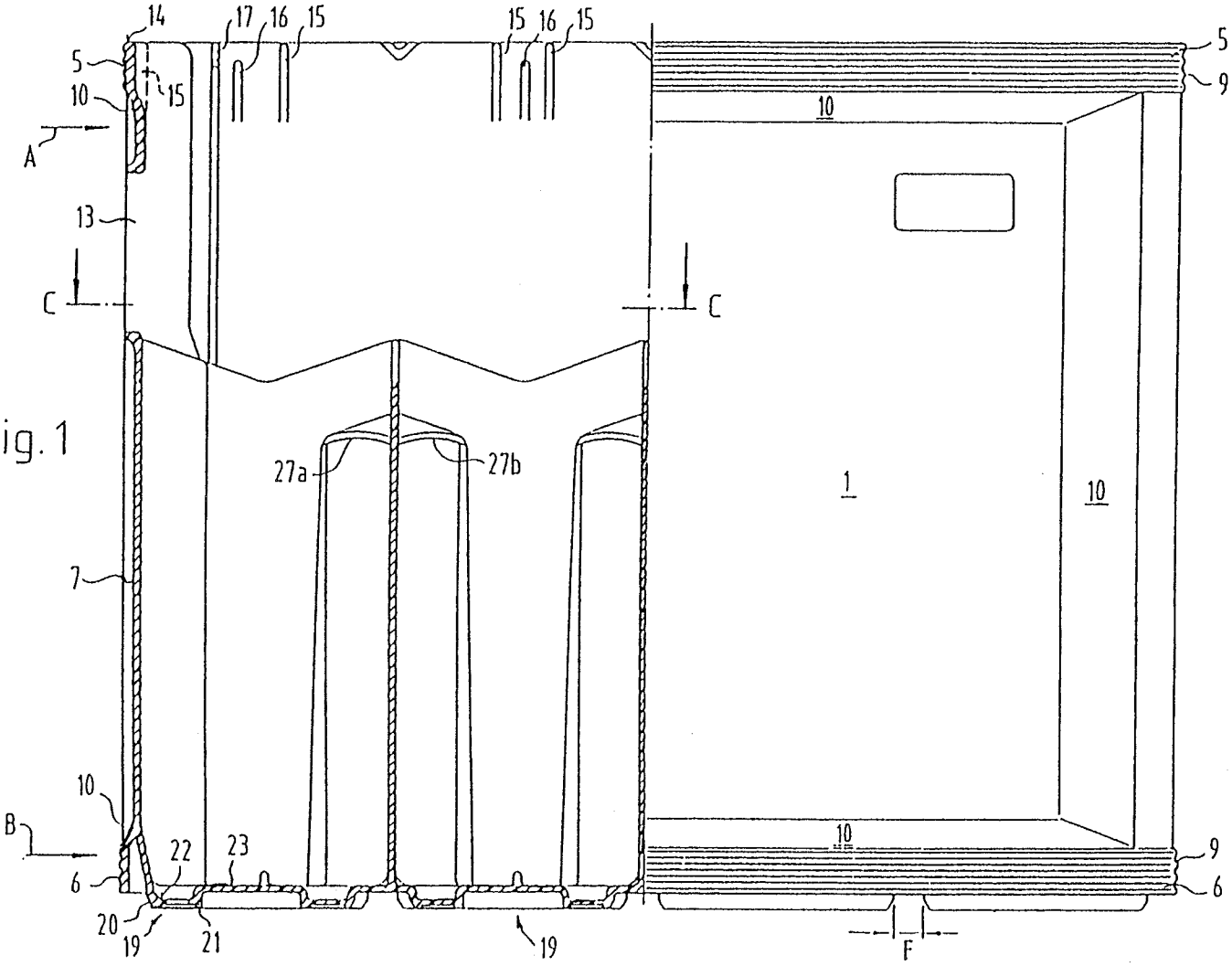

The invention relates to a stackable bottle crate from plastic material in accordance with the preamble of patent claim 1.

Stackable bottle crates are known in most different embodiments, wherein a particular problem in stackable bottle crates lies in making the crate so rigid that a perfect load transmission without deformations of the bottle crate is guaranteed. For the purpose of stiffening stackable bottle crates it is known to form hollow profiled columns in the side walls which columns are spaced with respect to one another and protrude into the interior of the crate. These hollow profiled columns provide the advantage that in addition to their stiffening function they simultaneously form holding faces for the bottles to be received in the crate. For permitting piling of bottle crates, herein the hollow profiled columns are not completely extended till the upper crate edge.

It is object of the invention to create a bottle crate which shows maximum stiffness with optimum minimization of weight, so that load transfer in the pile is possible without danger of damaging the bottle crate.

This object is solved in accordance with the invention by the features contained in the characterizing clause of claim 1, wherein advantageous further developments of the invention are characterized by the features contained in the subclaims.

According to claim 1 the hollow profiled columns are guided up to the upper marginal edge of the crate side walls, so that they together therewith form a circumferential piling edge for load transfer. In contrast to the traditional design in which the columns end by the insertion depth of the bottom below the adjacent crate margin, it is guaranteed by this embodiment that the hollow profiled columns contribute to load transfer. The hollow profiled columns in any arbitrary cross-sectional shape take over a full load portion. In this connection it is advantageous that in accordance with claim 2 the crate is reinforced on top and on bottom by a circumferential rib band, preferably of horizontal ribs, wherein a further stiffening of the crate is achieved by vertical ribs between the hollow profiled columns. This results in a bottle crate completely taking over load, the side walls of which crate can be kept extremely thin. This wall usually need not be thicker than corresponding cardboard layers in packagings from paper, so that it is rendered possible by the crate in accordance with the present invention to manufacture plastic crates and cardboard crates with identical exterior dimensions and to exchange them without problem, so that a mixed course of the two packaging manners is possible. This simplifies a step-by-step conversion of the two packaging modes, this being of great advantage for introducing bottle crates which are to substitute for cartonages.

This particular embodiment, in particular of the upper circumferential crate edge, allows a special bottom design which is suitable for staggered and composite piling. This is achieved by support ring structures formed at the crate bottom, namely at the bottom side of the crate bottom, and formed by ribs protruding downwardly and being circumferential like a ring. The dimensions of the support ring structure are increased by bulges, whereby the distance of the peak points of these island-like arranged support ring structures with respect to one another is decreased. In total, a greater bearing face of the crate results from these enlarged support ring structures, this being of substantial meaning for moving the crates free of vibrations also on roller tracks with larger distances of rollers. Furthermore, the arrangement of the island-like, i.e. per compartment, disposed support ring structure permits a linear piling as well as staggered piling of the bottle crates. In addition, the ribs protruding in downward direction increase friction on inclined conveyors. Nevertheless, these support ring structures do not inhibit the easy removal of the crates from the crate layer therebelow in case of manual handling. This design furthermore also is advantageous in case of mixed piling of cartonage and plastic units. The construction of the support ring structures in addition permits erection of the preferably triangular vertical hollow profiled columns and furthermore allows to easily pull away the piled crates due to the rounded contours.

Finally, in accordance with a further embodiment the mutually crossing compartment walls are reinforced in the points of intersection, namely by segmental walls bridging and connecting neigbouring compartment walls which per point of intersection mutually supplement to form a roof, stabilize the compartment work and permit a higher lateral loading of the crate.

Figure 2:
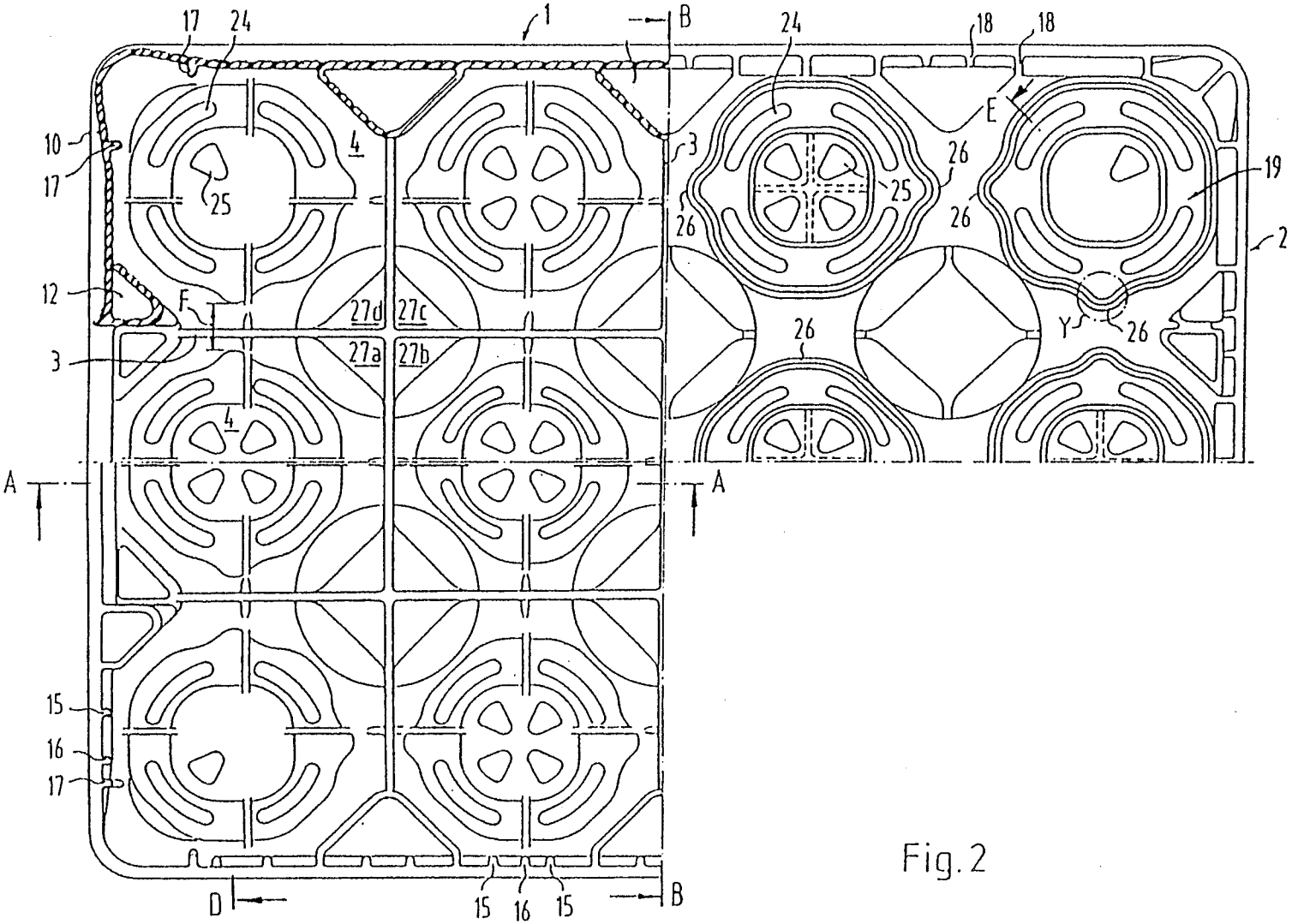
Figure 3:
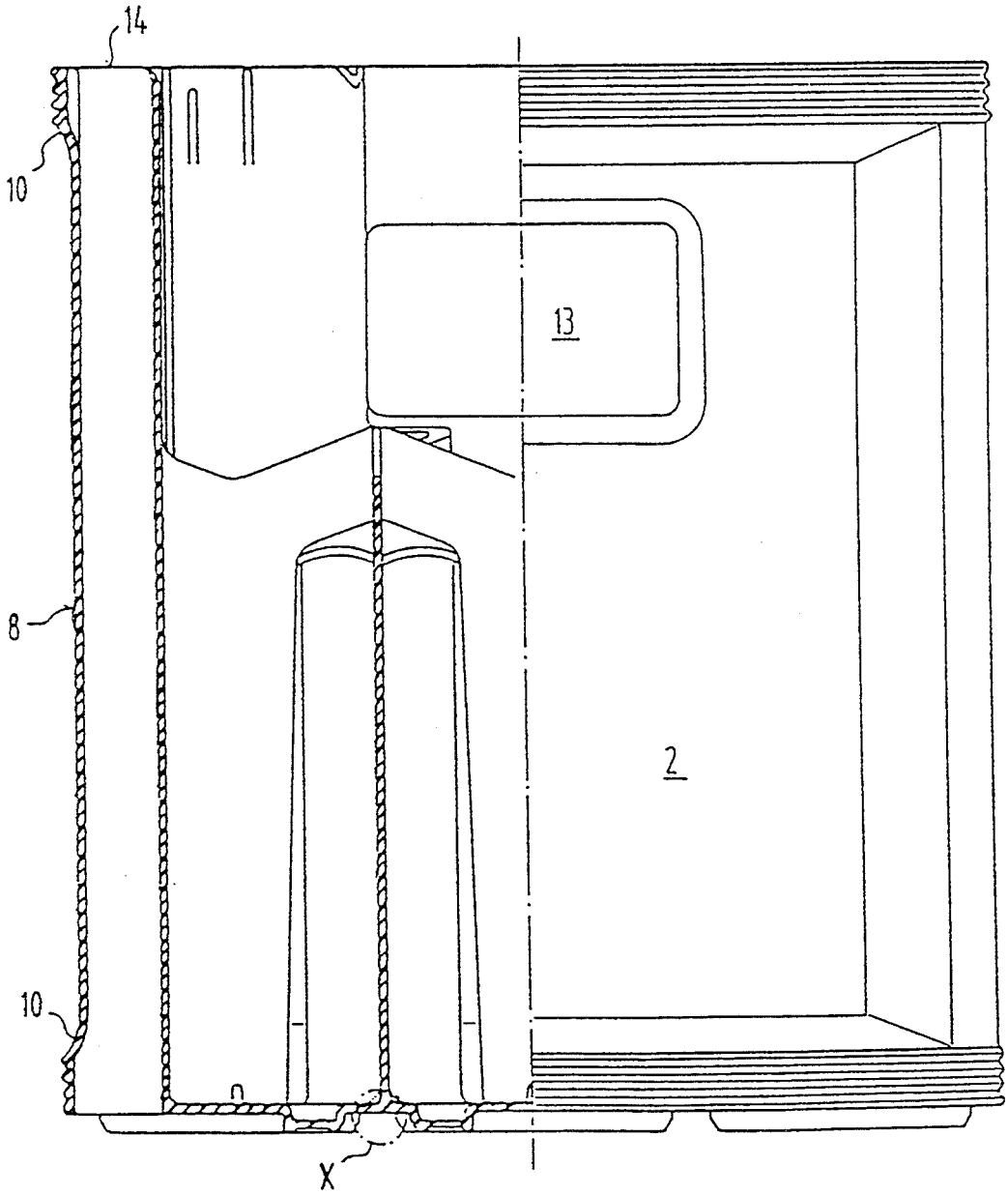
Figure 4:
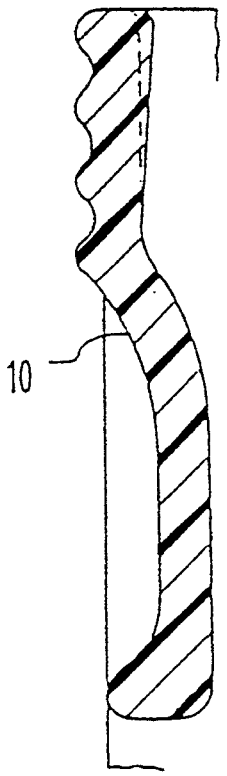
Figure 5:
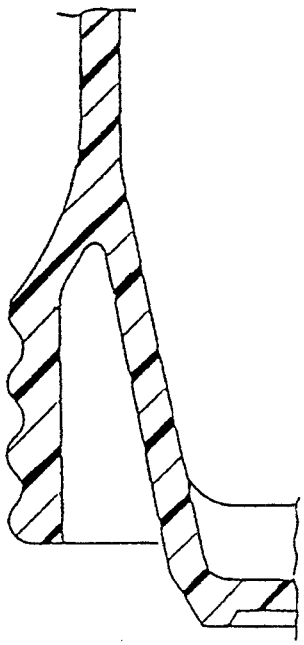
Figure 6:
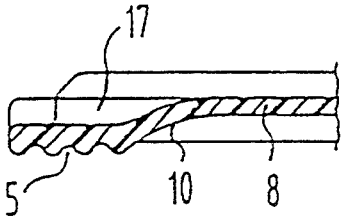
Figure 7:
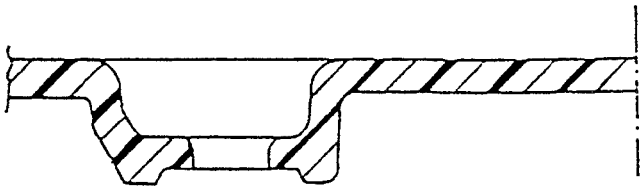
Figure 8:
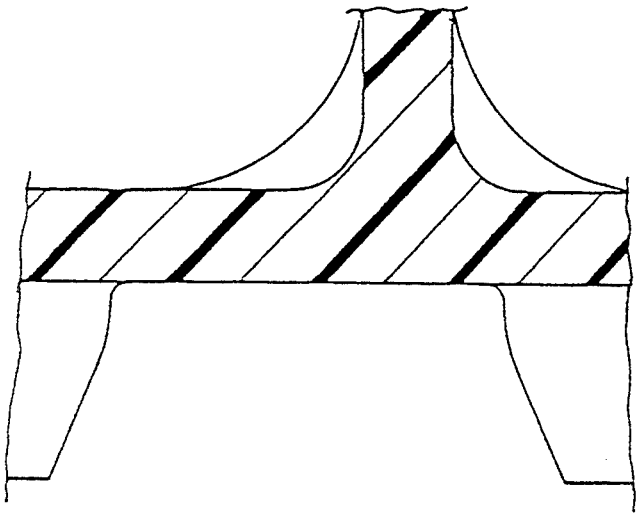
Figure 9:
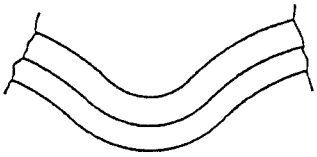
Figure 10:
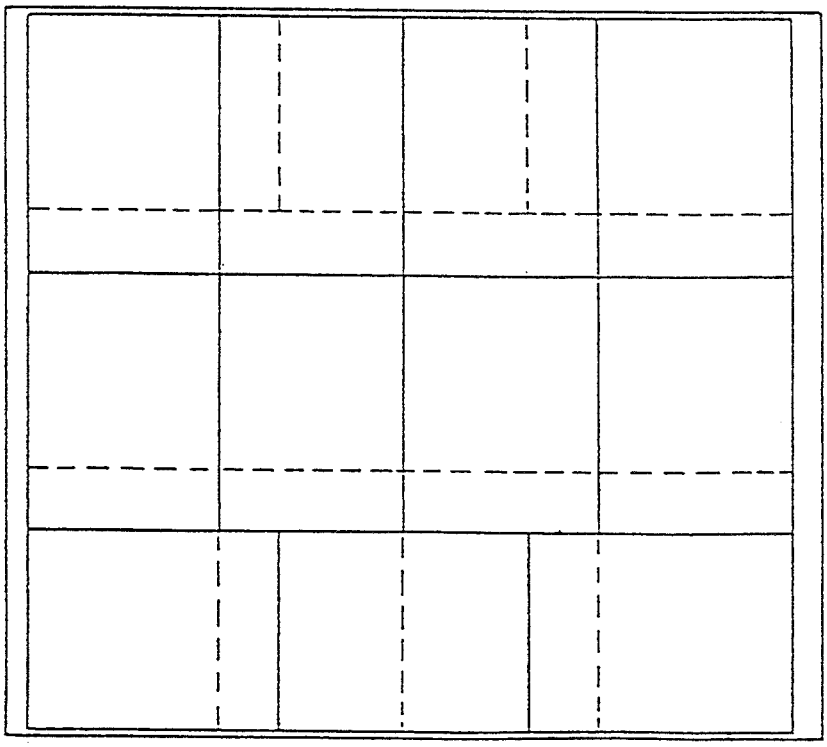

In the following a preferred embodiment of the invention will be described with reference to the drawings. Therein FIG. 1 shows a side view of a bottle crate, the left half of the crate representing a sectional view along line A—A of FIG. 2, FIG. 2 shows a top view onto a part of the bottle crate, wherein the upper left-hand quarter represents a sectional view along the line C—C of FIG. 1, the upper right-hand quarter shows a view of the crate bottom from bottom as well as the left-hand lower quarter shows a view of the crate from top, FIG. 3 shows a side view of the short side of the bottle crate, the left half representing a sectional view along the lien B—B of FIG. 2, FIG. 4 shows the detail A of FIG. 1, FIG. 5 shows the detail B of FIG. 1, FIG. 6 shows a section along the line D—D of FIG. 2, FIG. 7 shows a section along the line E—E of FIG. 2, FIG. 8 shows the detail X of FIG. 3, FIG. 9 shows the detail Y of FIG. 2 (upper left-hand quarter) as well as FIG. 10 shows a top view onto a pallet for showing different possibilities of piling the crate.

The bottle crate made from plastic material, shown in the drawings comprises two opposing long side walls 1 as well as two opposing short side walls 2 and serves for accomodating a total of 12 bottles in receiving compartments 4 formed by mutually crossing separation walls 3. Of course, it also is possible to provide for more or fewer compartments in the bottle crate, so that the statements made herein have to be regarded as exemplarily. At the upper and lower crate edge, the crate comprises one circumferential rib band 5 and 6 each, wherein the upper rib band 5 is shown in FIG. 4 and the lower rib band 6 is shown in FIG. 5 in more detail. The rib bands are displaced to the outside with respect to the corresponding vertical side wall face 7 and/or 8, respectively, and/or the corresponding vertical side wall face 7, 8 is slightly displaced to the inside with respect to the rib bands 5 and 6. The rib bands 5 and 6, each are formed by horizontal ribs 9 running around the crate, which ribs are formed on the outside of the rib bands 5 and 6, whereas the inner face of the rib bands 5 and 6, facing the interior of the crate to a great extent is level. In the shown embodiment each rib band 5 and 6 contains four ribs 9.

The vertical side wall faces 7 and 8 framed by the upper and the lower rib bands 5 and 6 as well as by the vertical corner edges of the crate, wherein the transition of the rib band and the corner edges into the vertical side wall face 7 and 8 is effected by rounded faces 10. By these slightly retracted side wall faces 7 and 8, an optimum protection of the advertising surfaces is obtained and furthermore it is rendered possible that the bottles received in the crate stand directly at the comparatively thin vertical side wall.

The side walls 1 and 2 are reinforced by hollow profiled columns 11 and 12 disposed at the inner face, wherein in the shown embodiment at the long side wall three hollow profiled columns 11 are disposed at the gaps with respect to the compartments and at the short side of the bottle (crate) two hollow profiled columns 12 are disposed. The hollow profiled columns 12 in the shown embodiment in their triangular cross-section correspond to the hollow profiled columns 11 approximately up to the height of the grip opening referred to by 13 and from there on extend as semi-profile and starting with the upper marginal edge of the grip opening again extend as full profile like the hollow profiled columns 11. This means that the grip opening 13 in the side wall of the crate at both sides is bordered by hollow profiled columns 12, whereby edge designs which render seizing of the crate more difficult and which are restricting in seizing, are done without. This simplifies handling of the crate due to omission of a sharp edge. It is of importance that the vertical hollow profiled columns 11 and 12 are extended up to upper marginal edge 14 of the crate, so that they together with the upper marginal edge of the rib band 5 form a circumferential piling edge. Thereby it is guaranteed that the hollow profiled columns which may show any arbitrary cross-sectional shape take over a full load portion. Thereby the crate is made fully load-carrying, wherein maximum rigidity combined with low compression factors is guaranteed at minimization of weight.

Furthermore, at the side walls between the hollow profiled columns 11 and 12 vertical ribs 15, 16 and 17 are formed to the inner faces of the side walls 1 and 2. The ribs 17 herein are arranged in the four corner areas of the crate and essentially extend over the entire height of the crate. They herein serve for reinforcing the corner section of the crate. The ribs 15 and 16 in the shown embodiment essentially extent over the height of the upper rib band 5 and the edge thereof running innermost runs in line with the inner wall of the vertical side wall face 7 and 8, as results from FIG. 1 upper left-hand side.

Comparable ribs 18 are arranged in the area of the lower rib band 6. The ribs 15 of the upper rib band 5 herein extend up to the upper circumferential piling edge 14, whereas the vertical ribs 16 end at a slight distance below the piling edge. These ribs cause a reinforcement of the upper and lower circumferential rib bands and in connection with the circumferential ribs 9 contribute against a bulging of the upper and lower crate rims in all directions.

The crate bottom is formed by special support ring structures 19 which are formed and/or arranged like islands, i.e. per compartment. These support ring structures extend from the bottom face downwardly, i.e. they are disposed at the lower bottom side. Each support ring structure comprises an outer circumferential ring-like rib 20 and an inner circumferential ring-like rib 21. These outer and inner ribs 20 and/or 21, respectively, herein protrude in downward direction. The outer rib 20 together with the inner rib 21 borders an annular bottom face 22, whereas a circular bottom face 23 is formed within the inner rib 21, which face is on a higher level with respect to the bottom face 22. Profiled openings having the approximate shape of bananas and being referred to by reference numeral 24, are provided for in the annular face 22. Openings 25 shaped like circular segments are provided for within the bottom face 23. These openings permit dirty water and cleasing water ocurring during rinsing of the crates to leak out and due to their dimensions at the same time prevent crown corks of the bottles from getting stuck.

In the area of the axes formed by the mutually crossing compartment walls the island-shaped support ring structures 19 are mutually spaced, as is marked with letter F in FIG. 2, left-hand bottom side. This results in the formation of so-called pull-off grooves between the island-shaped support ring structures.

It furthermore is essential that bulges 26 shown in closer detail in FIG. 9, are provided for in the area of the outer ribs. This results in increases of the dimensions of the support ring structures 19, this permitting a reduction of the island intervals and thus a noise-free movement on roller conveyors, even on roller bands with large roller distances.

In the points of intersection of the compartment walls 3 segmental walls 27*a*, 27*b*, 27*c* and 27*d* per point of intersection, which walls bridge neighbouring compartment walls and serve for reinforcement, are arranged, which walls supplement one another to form a roof, a roof-shaped square in the shown embodiment, and which stabilized the compartment work and therefore guarantee a higher lateral loading of the crate.

As can be seen from FIG. 10, the bottles crates permit piling in composite and staggered piling mode.

I claim:

1. A bottle crate from plastic material with four side walls, a crate bottom, an upper and lower marginal rim and compartment walls disposed in the interior of the crate for bordering accommodation compartments for bottles, comprising, vertical side walls having inner vertical and outer faces substantially filling the area between said upper and lower marginal rims reinforced by vertical hollow profiled columns protruding from said inner face of said side walls into the interior of the crate, said columns extending between said upper and lower marginal rims to form a circumferential piling edge for load reduction;

a continuous circumferential band having an inner and outer face;

parallel, horizontally extending ribs formed on said outer face of said band and extending outwardly there from;

said vertical outer faces of said side walls bordered by said circumferential, said outer band face of said band protruding outwardly farther than said vertical outer side faces;

said vertical inner side faces supporting bottles thereagainst; and crate corner edges formed by rounded faces.

2. Bottle crate as defined in claim 1, characterized in that at the upper and/or lower crate edge a circumferential rib band each with circumferential horizontal ribs is provided for at the outer side wall face.

3. Bottle crate as defined in claim 2, characterized in that the crate bottom at the bottom side thereof comprises island-like support ring structures arranged per compartment, which are formed by angularly circumferential ribs protruding downwardly.

4. Bottle crate as defined in claim 1, characterized in that the vertical side wall faces between the upper and lower rib band and between the vertical corner edges of the crate are slightly displaced to the inside with respect to the rib band and vertical crate corners and that the transition between the vertical side wall faces and the rib bands and/or corner edges, respectively, of the crate preferably are formed by round faces.

5. Bottle crate as defined in claim 1 with grip openings in at least one of the crate side walls, characterized in that each grip opening at both sides is bordered by hollow profiled columns.

6. Bottle crate as defined in claim 1, characterized in that the crate side walls at their inner face between the hollow profiled columns are reinforced by vertical ribs which preferably extend over the height of the upper and/or lower rib band and in the corner areas continually essentially extend over the entire crate height.

7. Bottle crate as defined in claim 1, characterized in that the crate bottom at the bottom side thereof comprises island-like support ring structures arranged per compartment, which are formed by angularly circumferential ribs protruding downwardly.

8. Bottle crate as defined in claim 7, characterized in that segmental walls connecting adjacent compartment walls and preferably supplementing one another to form a roof-shaped square in the point of intersection, are disposed in the points of intersection of the compartment walls.

9. Bottle crate as defined in claim 7, characterized in that each support ring structure is formed by an outer rib and an inner rib.

10. Bottle crate as defined in claim 7, characterized in that each support ring structure disposed and formed in island-like manner comprises bulges locally increasing the width dimensions of the structure, of the outer rib, which preferably are formed opposingly.

11. Bottle crate as defined in claim 7, characterized in that the support ring structure is mutually spaced in the axes defined by the compartment walls.

12. Bottle crate as defined in claim 7, characterized in that profiled openings are provided for in the bottom face between the outer and inner ribs as well as within the inner rib, the shape and/or dimensions of which openings prevent bottle crown corks from getting stuck.

13. Bottle crate as defined in claim 12, characterized in that the profiled openings between outer and inner ribs are formed by openings shaped like ring segments or like bananas and the profiled openings in the bottom face within the inner ribs are formed by openings shaped like circle segments.

14. Bottle crate as defined in claim 1, characterized in that segmental walls connecting adjacent compartment walls and preferably supplementing one another to form a roof-shaped square in the point of intersection, are disposed in the points of intersection of the compartment walls.

15. A plastic bottle crate comprising:

a crate having upper and lower circumferential edges and corner edges formed by inclined faces;

side vertical walls having vertical inner and outer faces substantially filling the area between said upper and lower circumferential edges and supporting bottles thereagainst reinforced by vertical hollow profiled columns on said inner side wall face, said columns extending to said upper and lower edges of said crate;

a continuous circumferential band having an inner and outer face, said band having several parallel, horizontally extending ribs, said rib formed on said outer face of said band and extending outwardly therefrom, said outer face of said band protruding outwardly farther than said outer side faces of said sidewalls.

16. The bottle crate as set forth in claim 15, wherein said circumferential rib has at least four horizontal ribs provided for at said outer side wall faces.

17. The bottle crate as set forth in claim 15, wherein said crate has more than one circumferential horizontal rib.

18. The bottle crate as set forth in claim 15, wherein said crate has four circumferential horizontal ribs.

19. The bottle crate as set forth in claim 15, wherein said side walls are formed by inclined or round faces and are displaced to the inside of said crate with respect to said rib band and corners.

20. The bottle crate as set forth in claim 15, further comprising grip openings in said side walls, said openings bordered by said hollow profiled columns.

21. The bottle crate as set forth in claim 15, wherein said hollow profiled columns are reinforced by vertical ribs.

22. The bottle crate as set forth in claim 15, further comprising a crate bottom having island-like support ring structures formed by angularly circumferential ribs protruding downwardly.

23. The bottle crate as set forth in claim 22, wherein said support ring structure comprises bulges that increase the width dimensions of said ribs.

24. The bottle crate as set forth in claim 22, wherein said support ring structure is mutually spaced in the axes defined by said compartment walls.

25. The bottle crate as set forth in claim 22, wherein said support ring structures have banana-like openings and circle segment openings therein.

26. The bottle crate as set forth in claim 22, wherein said support ring structure is formed by an outer rib and an inner rib.

27. The bottle crate as set forth in claim 15, further comprising profiled openings between said outer and inner ribs, the shape of said openings preventing bottle crown corks from getting stuck.

28. The bottle crate as set forth in claim 15, further comprising segmental walls interconnected with said compartment walls to form a roof-shaped square.

29. The crate as set forth in claim 1, wherein said bottles received in said crate are supported by said vertical side faces.

30. The crate as set forth in claim 1, wherein no horizontal ribs are positioned between said upper and lower marginal rims.

* * * * *